US007637350B2

(12) United States Patent
Conroy

(10) Patent No.: US 7,637,350 B2
(45) Date of Patent: Dec. 29, 2009

(54) PORTABLE BARGE ACCESS LADDER

(75) Inventor: Jeffrey A. Conroy, Pittsburgh, PA (US)

(73) Assignee: Interstate Equipment Corporation, Pittsburgh, PA (US)

( * ) Notice: Subject to any disclaimer, the term of this patent is extended or adjusted under 35 U.S.C. 154(b) by 1139 days.

(21) Appl. No.: 10/852,750

(22) Filed: May 24, 2004

(65) Prior Publication Data

US 2004/0231919 A1 Nov. 25, 2004

Related U.S. Application Data

(60) Provisional application No. 60/473,076, filed on May 23, 2003.

(51) Int. Cl.
*E06C 9/00* (2006.01)

(52) U.S. Cl. ..... 182/93; 182/204

(58) Field of Classification Search ..... 182/93, 182/84, 95, 82, 200–205, 115
See application file for complete search history.

(56) References Cited

U.S. PATENT DOCUMENTS 3,012,626 A * 12/1961 Marryatt ..... 182/70
4,054,182 A 10/1977 Ide
4,676,342 A * 6/1987 Godde ..... 182/201
5,022,491 A * 6/1991 Gill ..... 182/95
5,497,850 A * 3/1996 Patterson ..... 182/204
5,845,741 A * 12/1998 Dwyer ..... 182/84
6,073,726 A * 6/2000 McCrystal ..... 182/195
6,224,296 B1 * 5/2001 Fukumori ..... 405/282
6,533,069 B1 * 3/2003 Couillard ..... 182/83
6,769,513 B2 * 8/2004 Pettit ..... 182/115
6,907,957 B1 * 6/2005 Couch ..... 182/206

* cited by examiner

*Primary Examiner*—Alvin C Chin-Shue
(74) *Attorney, Agent, or Firm*—Blynn L. Shideler; Krisanne Shideler; BLK Law Group

(57) ABSTRACT

The portable barge access ladder has a pair of coaming frame members positioned outside of a barge coaming with a plurality of safety treads there-between forming a coaming ladder portion. The ladder includes transverse frame members extending across the barge coaming with a decking tread member there-between forming a walkway for the operator to easily traverse the coaming. Angled hold frame members extend into the barge hold with conventional safety treads there-between at least partially forming a hold access ladder portion. The ladder includes adjustable legs slidably received in the hold frame members with one or more auxiliary treads attachable to the legs forming optional additional treads for the ladder as the legs are extended. The removable auxiliary treads will be used where the legs are extended beyond standard tread spacing. A combing securing mechanism is provided to prevent ladder lateral slippage during use.

6 Claims, 2 Drawing Sheets

PORTABLE BARGE ACCESS LADDER

CROSS REFERENCE TO RELATED APPLICATION

The present application claims the benefit of provisional patent application Ser. No. 60/473,076 entitled "PORTABLE BARGE ACCESS LADDER" filed on May 23, 2003 that is incorporated herein by reference in its entirety.

BACKGROUND OF THE INVENTION

1. Field of the Invention

The present invention relates to a safe portable access ladder for straddling the coaming of hopper barges and providing access to the hold of the hopper barge.

2. Background Information

Hopper barges are often used for transporting a variety of laden. Often workers will be required to clean the hopper holds prior to taking on a new cargo. In order to clean the hold the workers must climb down into the hold from the gunnel. Workers will also need access to the hold for routine maintenance. Access to the hold requires the workers to climb over the coaming surrounding the hold and then down into the hold. Conventional extension ladders are often utilized for this purpose, but they are not easily secured in positioned on the inside of the hold and offer no assistance in climbing the coaming.

U.S. Pat. No. 4,054,182 discloses a dock mounted ladder carriage providing a ladder retractably slid into position within the hold of a barge. The '182 patent does not provide barge access from the barge gunnel so it also does not provide any assistance in climbing the coaming. The access system of the '182 patent does not provide any additional safety to the workers.

It is an object of the present invention to provide a safe convenient way to access hopper barge holds that can be easily positioned with existing dock equipment.

SUMMARY OF THE INVENTION

The above stated objects achieved with a portable barge access ladder according to the present invention. The portable barge access ladder according to the present invention includes a pair of coaming frame members positioned outside of a barge coaming with a plurality of safety treads between the coaming frame members forming a coaming climbing ladder portion. The portable barge access ladder includes transverse frame members extending across the top of the barge coaming with a decking tread member there between forming a walkway or access for the operator to easily traverse the coaming. Angled hold frame members extend at a desired inclination into the barge hold with conventional safety treads there between at least partially forming a hold access ladder portion. The portable barge access ladder includes adjustable legs slidably received in the hold frame members with one or more auxiliary treads that can be bolted to the legs forming optional additional treads for the ladder as the legs are extended. The removable auxiliary treads will be used where the legs are extended to a point where the distance between the lowermost permanent tread and the floor of the hold is greater than the distance between the permanent treads.

An angle stop extends between the transverse frame members and is adjustably secured thereto. The adjustable stop and the coaming frame members form an adjustable coaming securing structure preventing significant lateral movement, or slippage, of the ladder that accommodates different coamings of distinct barges. The portable ladder includes safety handrails attached to and extending along the transverse frame members and the substantially along the length of the hold frame members to form hand rail guides for the coaming walkway and the hold access portion of the ladder. A pair of chains attached at appropriate lift points on the frame members and secured to a spreader having a lift point allows the ladder to be easily positioned with a crane.

These and other advantages of the present invention will be clarified in the description of the preferred embodiment together with the attached figures were like reference numeral represent like elements throughout.

DESCRIPTION OF THE PREFERRED EMBODIMENTS

Figure 1:
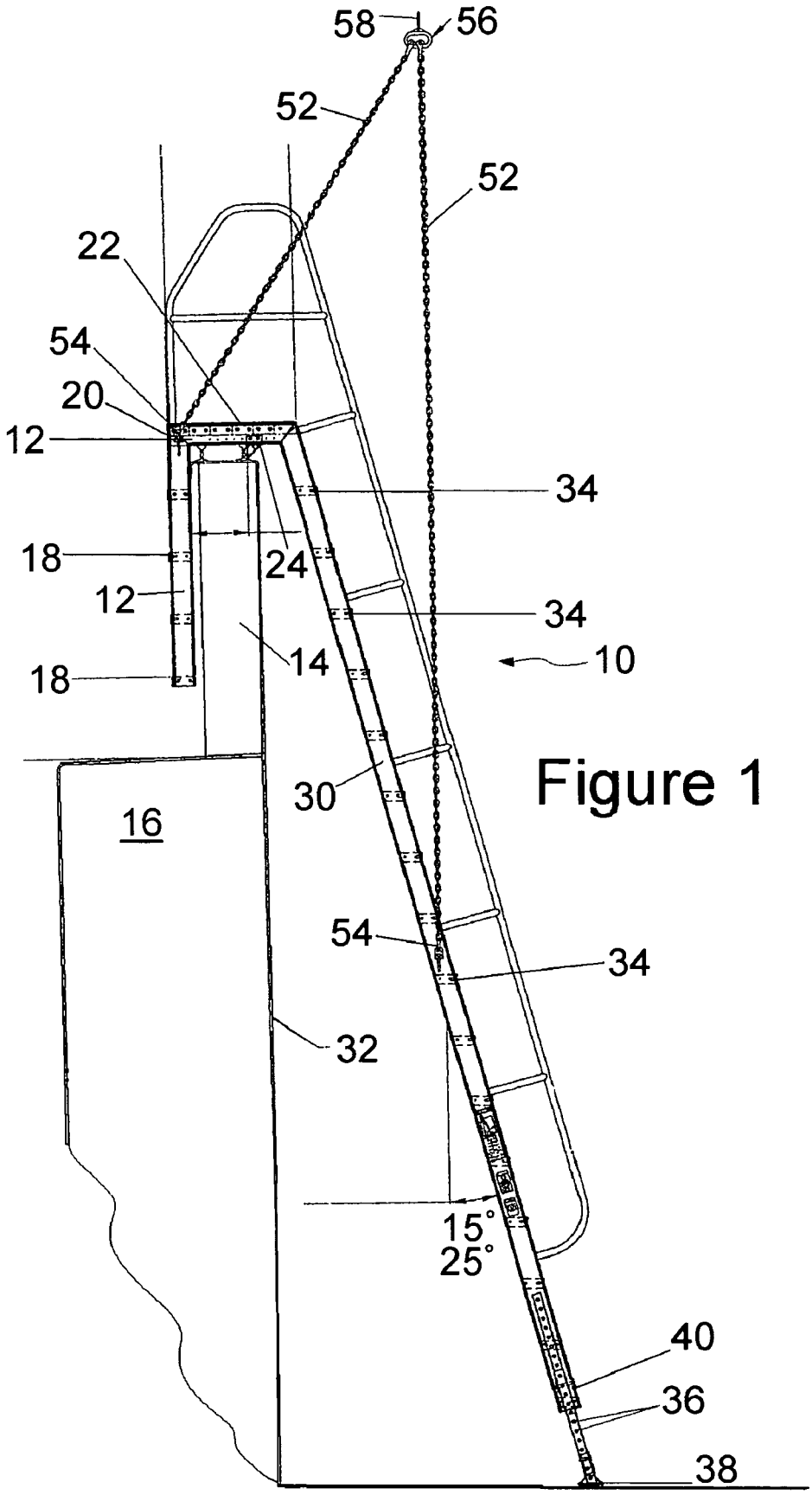
FIG. 1 is a side view of a portable barge access ladder according to the present invention.
Figure 2:
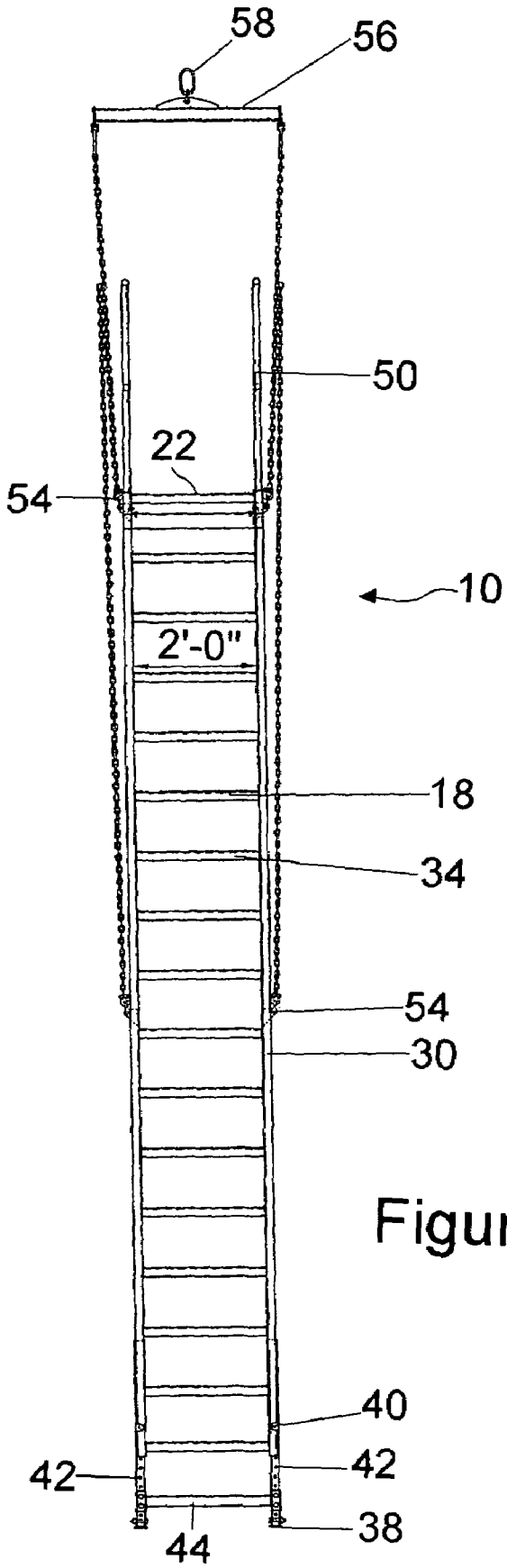
FIG. 2 is a front view of the portable barge access ladder of FIG. 1.

FIGS. 1-2 illustrate the portable barge access ladder 10 according to the present invention. The portable barge access ladder 10 includes a pair of steel coaming frame members 12 adapted to be positioned outside of a coaming 14 of a barge 16. A plurality of aluminum safety treads 18 extend between the coaming frame members 12 forming a coaming climbing ladder portion of the portable barge access ladder 10.

At one end of the steel coaming frame members 12 are steel transverse frame members 20 adapted to extend across the top of coaming 14 of the barge 16. An aluminum decking tread member 22 extends between the transverse frame members 20. The decking tread member 22 forms a walkway or access for the operator to easily traverse the coaming 14.

An angle stop 24 extends between the transverse frame members 20 and is adjustably secured thereto through bolts or other fasteners through a selected pair of a series of holes 26 in each transverse frame member 20. The stop 24 is generally adjacent an inner structure of the coaming 14, as shown in FIG. 1. The stop 24 and the coaming frame members 12 combine to form an adjustable coaming securing mechanism or structure preventing significant lateral movement, or slippage, of the ladder 10. The series of holes 26 in each transverse frame member allow for the adjustment of the relative position of the stop 24 to accommodate different structures of the coaming 14 of distinct barges 16.

The end of the transverse frame members 20 spaced from the coaming frame members 12 are coupled to angled, steel hold frame members 30 adapted to extend at a desired inclination, generally about 15-25 degrees, into the hold 32 of the barge 16. Conventional aluminum safety treads 34 extend between the hold frame members 30 at least partially forming a hold access ladder portion of the portable barge access ladder 10.

The lower end of each hold frame member 30 includes an adjustable leg 36 slidably received therein with a pivotable base or foot 38 adapted to abut a floor of the hold 32 of the barge 16. A leg pin 40 extends through a pair of holes in a hold frame member 30 and through one of a series of holes 42 in the leg 36 to adjustably attach the leg 36 the hold frame member 30. Additionally, one or more auxiliary aluminum treads 44 can be bolted to the legs 36 forming additional treads for the ladder 10 as the legs 36 are extended. The treads 34 and 44 form the hold access ladder portion of the portable barge access ladder 10 of the present invention. The removable treads 44 will be used where the legs 36 are extended to a point where the distance between the lowermost tread 34 and the floor of the hold 32 is greater than the distance between the treads 34. It is possible that more than one tread 44 could be used (e.g. if the legs 36 were extended more than twenty-four inches), or that in certain applications (i.e. certain barges) no treads 44 will be required (e.g. if the legs 36 were extended less than twelve inches). For the safety of the worker the distance between the floor of the hold 32 and the first tread (44 or 34) of the ladder 10 should be generally equal to or less than the distance between the treads 34. For example, a safety tread 44 should be attached when the legs 36 are extended more than twelve inches, with the tread attached at a position twelve inches below the lowermost tread 34.

The portable ladder 10 includes safety handrails 50 attached to and extending along the transverse frame members 20 and the majority of the length of the hold frame members 30 to form hand rail guides for the coaming walkway and the hold access portion of the ladder 10. The handrails 50 stop before the hold floor end of the hold frame members 30 so as not to interfere with the operators, but will generally be within reach of an operator standing on the floor of the hold 32 as he climbs the ladder 10.

The portability of the ladder 10 is improved with a pair of chains 52 attached at appropriate lift points 54 on the frame members 20 and 30 as shown. The chains 52 extend to and are attached to a spreader 56 having a lift point 58. The chains 52, spreader 56 and lift point 58 allow the ladder 10 to be easily, quickly and safely positioned and removed with a dock crane, or the like.

The ladder 10 provides suitable access to the hold 32 from the gunnel of several distinct barges 34. Typical hopper or hold depths are 15'9" (12' hull with 5'-0" coaming and 13' hull with 4'-0" coaming) and 16'-9" (12', 13' and 14' hulls with 4'-0", 5'-0" and 6'-0" coamings, respectively). Other non-standard hold depths are possible and easily accommodated with the ladder of the present invention.

In operation the ladder 10 may be positioned over the coaming 14 with a crane (not shown) using chains 52. The stop 24 is adjusted to be adjacent the inside of the coaming when the coaming frame members 12 are flush against the outside of the coaming 14 to prevent any movement of the ladder 10 while operators are accessing the hold 32. Additionally the legs 36 are adjusted to the hopper depth and a tread 44 is provided where needed.

Various modifications of the present invention may be made without departing from the spirit and scope thereof. For example, the handrail and the frame members may be painted safety yellow to improve visibility and further increase safety. The hold frame members may be pivotally attached to the transverse frame members to allow for varying of the inclination angle as desired. The described embodiment is not intended to be restrictive of the present invention. The scope of the present invention is intended to be defined by the appended claims and equivalent thereto.

What is claimed is:

1. A portable ladder comprising:

a pair of coaming frame members adapted to be positioned outside of a barge coaming;

a plurality of safety treads extending between and attached to the coaming frame members forming a coaming ladder portion;

a pair of transverse frame members attached to the pair of coaming frame members at one end thereof, wherein the transverse frame members are substantially perpendicular to the coaming frame members whereby the transverse frame members are adapted to extend across the barge coaming;

a decking tread member extending between and attached to the transverse frame members forming a walkway for an operator to traverse the coaming;

hold frame members attached to one end of the transverse frame members, wherein the hold frame members have a distal end that is spaced from the transverse frame members and is vertically lower than a distal end of the coaming frame members that is spaced from the transverse frame members whereby the hold frame members are adapted to extend into the barge hold;

a plurality of safety treads extending between and attached to the hold frame members at least partially forming a hold access ladder portion;

adjustable legs slidably received in the hold frame members;

at least one auxiliary tread attachable to the legs forming optional additional treads for the ladder as the legs are extended; and a coaming securing mechanism to prevent ladder lateral slippage during use, wherein the coaming securing mechanism includes a stop adjustably attached to the transverse frame members.

2. A portable ladder comprising:

a pair of coaming frame members adapted to be positioned outside of a barge coaming;

a plurality of safety treads extending between and attached to the coaming frame members forming a coaming ladder portion;

a pair of transverse frame members attached to the pair of coaming frame members at one end thereof, wherein the transverse frame members are substantially perpendicular to the coaming frame members whereby the transverse frame members are adapted to extend across the barge coaming;

a decking tread member extending between and attached to the transverse frame members forming a walkway for an operator to traverse the coaming;

hold frame members attached to one end of the transverse frame members, wherein the hold frame members have a distal end that is spaced from the transverse frame members and is vertically lower than a distal end of the coaming frame members that is spaced from the transverse frame members whereby the hold frame members are adapted to extend into the barge hold;

a plurality of safety treads extending between and attached to the hold frame members at least partially forming a hold access ladder portion;

adjustable legs slidably received in the hold frame members;

at least one auxiliary tread attachable to the legs forming optional additional treads for the ladder as the legs are extended; and lifting chains secured to selected frame members to provide for lifting of the ladder, wherein the chains are attached to lift points on the transverse frame members and the hold frame members.

3. The portable ladder of claim 2 wherein the chains are attached to a spreader bar with a lift point.

4. A portable ladder comprising:

a pair of coaming frame members adapted to be positioned outside of a barge coaming;

a plurality of safety treads extending between and attached to the coaming frame members forming a coaming ladder portion;

a pair of transverse frame members attached to the pair of coaming frame members at one end thereof, wherein the transverse frame members are substantially perpendicular to the coaming frame members whereby the transverse frame members are adapted to extend across the barge coaming;

a decking tread member extending between and attached to the transverse frame members forming a walkway for an operator to traverse the coaming;

hold frame members attached to one end of the transverse frame members, wherein the hold frame members have a distal end that is spaced from the transverse frame members and is vertically lower than a distal end of the coaming frame members that is spaced from the transverse frame members whereby the hold frame members are adapted to extend into the barge hold;

a plurality of safety treads extending between and attached to the hold frame members at least partially forming a hold access ladder portion;

adjustable legs slidably received in the hold frame members; and coaming securing mechanism to prevent ladder lateral slippage during use, wherein the coaming securing mechanism includes a stop adjustably attached to the transverse frame members.

5. A portable ladder comprising:

a pair of coaming frame members adapted to be positioned outside of a barge coaming;

a plurality of safety treads extending between and attached to the coaming frame members forming a coaming ladder portion;

a pair of transverse frame members attached to the pair of coaming frame members at one end thereof, wherein the transverse frame members are substantially perpendicular to the coaming frame members whereby the transverse frame members are adapted to extend across the barge coaming;

a decking tread member extending between and attached to the transverse frame members forming a walkway for an operator to traverse the coaming;

hold frame members attached to one end of the transverse frame members, wherein the hold frame members have a distal end that is spaced from the transverse frame members and is vertically lower than a distal end of the coaming frame members that is spaced from the transverse frame members whereby the hold frame members are adapted to extend into the barge hold;

a plurality of safety treads extending between and attached to the hold frame members at least partially forming a hold access ladder portion;

adjustable legs slidably received in the hold frame members;

coaming securing mechanism to prevent ladder lateral slippage during use, and lifting chains secured to selected frame members to provide for lifting of the ladder wherein the chains are attached to lift points on the transverse frame members and the hold frame members.

6. The portable ladder of claim 5 wherein the chains are attached to a spreader bar with a lift point.

* * * * *